US005806904A

United States Patent [19]

Smith

[11] Patent Number: 5,806,904

[45] Date of Patent: Sep. 15, 1998

[54] BOTTLE LIFTING DEVICE

[76] Inventor: Byron J. Smith, 8 Whittington Ct., Greenville, S.C. 29615

[21] Appl. No.: 747,237

[22] Filed: Nov. 12, 1996

[51] Int. Cl.[6] ..... B65D 23/10

[52] U.S. Cl. ..... 294/31.2; 294/137; 215/396

[58] Field of Search ..... 294/27.1, 31.2, 294/33, 90, 137, 145, 149, 153, 156, 165, 166; 215/396–399; D9/434

[56] References Cited

U.S. PATENT DOCUMENTS

| | | | |
|---|---|---|---|
| D. 187,500 | 3/1960 | Jennings et al. | 215/396 |
| 1,032,921 | 7/1912 | Mathias | 294/145 |
| 1,253,903 | 1/1918 | Stevens . | |
| 1,298,662 | 4/1919 | Chadwick | 294/27.1 |
| 1,342,568 | 6/1920 | Pearson | 215/396 |
| 1,474,322 | 11/1923 | Ducorron . | |
| 1,700,570 | 1/1929 | Hogberg | 215/396 |
| 1,777,102 | 9/1930 | Mooney . | |
| 1,839,636 | 1/1932 | Baker . | |
| 1,993,976 | 3/1935 | Nelson . | |
| 2,668,539 | 2/1954 | Dermody . | |
| 2,806,731 | 9/1957 | Comstock, Jr. . | |
| 2,970,729 | 2/1961 | Allen | 294/149 |
| 3,000,527 | 9/1961 | Jennings et al. | 294/31.2 |
| 3,311,252 | 3/1967 | Swartwood et al. | 215/397 |
| 3,463,536 | 8/1969 | Updegraff et al. | 215/396 |
| 3,520,570 | 7/1970 | Christopher et al. . | |
| 3,612,595 | 10/1971 | Updegraff et al. | 294/31.2 |
| 4,236,743 | 12/1980 | Fox . | |
| 4,579,237 | 4/1986 | Gagnon | 215/396 |
| 4,582,215 | 4/1986 | Barrash | 294/31.2 |
| 4,627,546 | 12/1986 | Carranza . | |
| 4,724,971 | 2/1988 | Henline . | |
| 4,730,863 | 3/1988 | Guadnola . | |
| 4,772,133 | 9/1988 | Volk . | |
| 4,773,549 | 9/1988 | Avraham . | |
| 4,818,121 | 4/1989 | Volk . | |
| 5,085,477 | 2/1992 | Gagnon . | |

FOREIGN PATENT DOCUMENTS

| | | | |
|---|---|---|---|
| 1564081 | 4/1969 | France | 294/137 |

*Primary Examiner*—Dean Kramer

[57] ABSTRACT

A bottle lifting device that can be used to safely pick up and carry heavy water bottles, two at a time utilizing only one hand each; which can be mass produced inexpensively, and which can easily be stored in the pocket when not in use. The lifter provides an area for advertising and incorporates proper lifting information. The lifting device utilizes a molded ring on the top of the neck of the water bottle as a pinch point surface and the neck structure of the bottle as the other pinch point surface. The pinching action occurs in void 3 when the lifter is assembled over the neck of the bottle and is then raised by inserting a human hand into void 2 and applying upward force to raise the bottle off of a surface into the lifted and carrying position. The specifications of the material of the body 1 are such that minimal bending of the body 1 will occur during its use. Only enough bending will occur to assure that the lifter remains engaged with the underside of the molded ring on the neck of the bottle and the neck of the bottle.

1 Claim, 3 Drawing Sheets

BOTTLE LIFTING DEVICE

BACKGROUND-FIELD OF INVENTION

This invention relates to bottle handling and lifting devices, specifically to large [19 liter, 0.45 kilograms, 5 gallon ] bottles normally used for potable water.

BACKGROUND-DESCRIPTION OF PRIOR ART

Water bottling and supply companies through the United States have been providing purified and clean potable water to customers where such clean water is not readily available or local water supplies are not desirable. They also provide dispensing and cooling apparatuses for the water.

Supplies of potable water have normally been in three sizes. One size is the normal hand held, personal drink size of up to one liter, the second size is normally a one gallon size for use in the home where more than one person is supplied. Both of these sizes are normally for home use and as such the water containers are available at grocery stores.

The third size is normally in larger containers of 19 liters. This size container is usually only available through the services of a water bottling and supply company. It is the handling and lifting of water bottles in this size which my invention addresses. Recently a new 2 ½ gallon size of the same configuration has been added to the market. The design shown, with modifications to the sizes mentioned can be used for this smaller size water bottle.

Traditionally bottles of this size were made of glass but in the majority of applications, bottles have been converted to plastic construction. This change significantly reduced losses due to breakage during handling and also significantly reduced the overall weight of the bottle and contents.

The design of the newer plastic bottles has copied the more traditional glass bottles in that the configuration of the bottles is a round bottle terminating in a smaller neck, which is used for filling and providing a secure seal till dispensing is commenced. This new material continues to utilize neck construction that has a molded ring on the top of the neck.

The preferred design of lifting devices of bottles in this size would incorporate the following features;

- reusable
- safe lifting and handling capability
- fill enclosure of the bottle neck to assure the bottle not slipping out of the lifter
- capability of attaching the lifer to the bottle easily with one hand
- ease of manufacturing and low costs
- small and easy to carry on the person
- provide a place for safety instructions and advertisement The safe and easy handling of liquid holding containers has spurred a very large number of patents, from as far back as 1912.

Many of the issued patents including: U.S. Pat. No. 1,253,903 issued to Stevens (1918), U.S. Pat. No. 1,474,322 issued to Ducorron (1922), U.S. Pat. No. 1,777,102 issued to Mooney (1929), U.S. Pat. No. 1,839,636 issued to Baker (1930), US patent issued to Nelson (1932), U.S. Pat. No. 2,806,731 issued to Comstock (1953) all address the handling and lifting of one quart milk bottles. The designs are based upon the concept of lifting bottles by their necks with the use of a wire structure, which may be perfectly safe way of handling lighter weights in the 1.9 liter configuration. Handling of the 19 liter size containers could pose a hazard to the hands of the person doing the lifting. My invention does not address the lifting and handling of the one quart size milk bottles.

Other patents have approached the needs to lift two liter plastic bottles. U.S. Pat. No. 4,627,546 issued to Carranza (1986) for a lifting device for two liter bottles appears to negate the problem of wire cutting into the hand of the person carrying the bottle but the design requires a very large piece of plastic and two hands to assemble the lifting device onto the bottle. This device does not overcome the apparent problems of the slippery nature of plastic bottles and the additional concerns of the bottles being wet and thus hampering the adhesion of the major body straps. The same mounting, slipping and production costs problems exist with U.S. Pat. No. 4,724,971 issued to Henline (1988).

Another two liter lifter U.S. Pat. No. 4,773,549 issued to Avraham (1988) uses the side of the bottle as a stabilizing device and also as part of the method of assuring the bottle neck does not separate from the lifter. This additional support and the design of the handle would require significant manufacturing costs. Two liter bottle sizes are outside the interest area of this invention.

Several patents have been issued for designs to provide the ability to handle and lift larger (up to 19 liters) water bottles. U.S. Pat. No. 3,520,570 issued to Christoper (1968) shows a design of an open sided carrier. This approach does not lock the bottle neck in and could be susceptible to the bottle being dropped from the carrier. The carrier is also balky to carry and its metallic construction would make it rather expensive to manufacture.

U.S. Pat. No. 4,236,743 issued to Valencia (1980) is a five part device which utilizes opposing forces on the two parts of the handle to firmly grasp the bottle neck. This appears to be a satisfactory method of grasping the bottle however it requires the person using the device to use both hands to engage the lifter. In addition the lifter would be very expensive to manufacture and could not be easily slipped into the pocket of the person handling the bottles.

U.S. Pat. No. 5,085,477 issued to Gagmon (1992) is a modification of the wire construction of the milk bottle lifters. The requirements of lifting 0.45 kilograms bottles would put into question the ability of a metal frame to withstand the forces generated while maintaining the necessary shapes required to assure sufficient contact between the bottle and the lifter. The cost to manufacture such a lifter would be expensive and the device would be difficult to store on the person when not in use.

Objects AND Advantages

The objects and advantages of the invention described in this application are:

a) to provide a reusable device for lifting and handling large plastic bottles b) to provide a device that has no moving parts and is very economical to manufacture c) to provide a device that can easily be carried in the pocket of normal work clothes when not in use d) to provide an opportunity for the bottled water supplier to advertise on the device in such a location to be readily visible to the consumer e) to provide the suppliers advertisement to be located in a position where it will not be in contact with any other surface f) to provide an opportunity to slip the lifting device over the bottle neck using only one hand, and allowing the carrier to carry two bottles at one time g) to provide a very visible position where correct lifting information is shown.

DRAWING FIGURES

DESCRIPTIONS AND OPERATION

Figure 1:
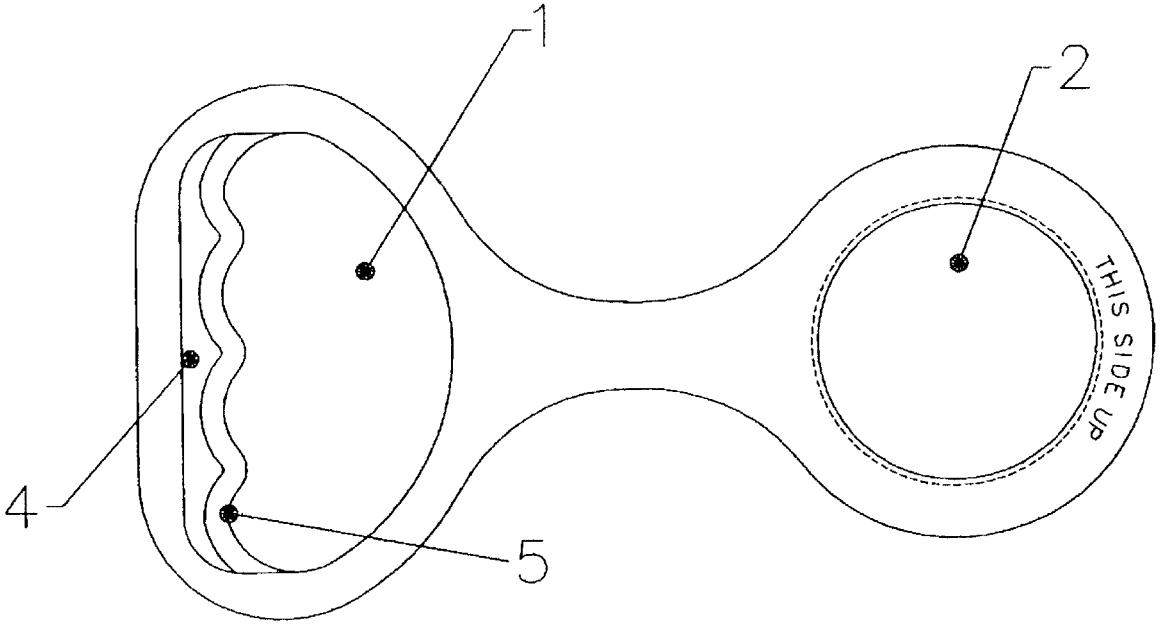
FIG. 1 is a top view
Figure 2:
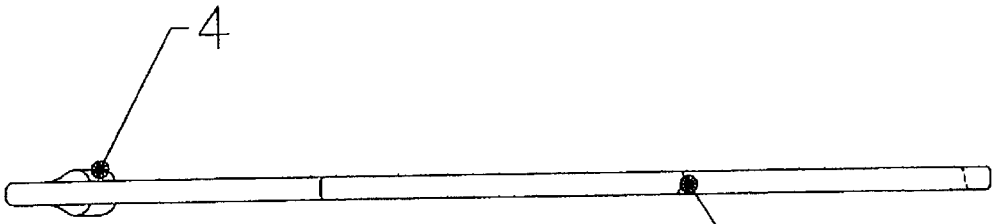
FIG. 2 is a side view
Figure 3:
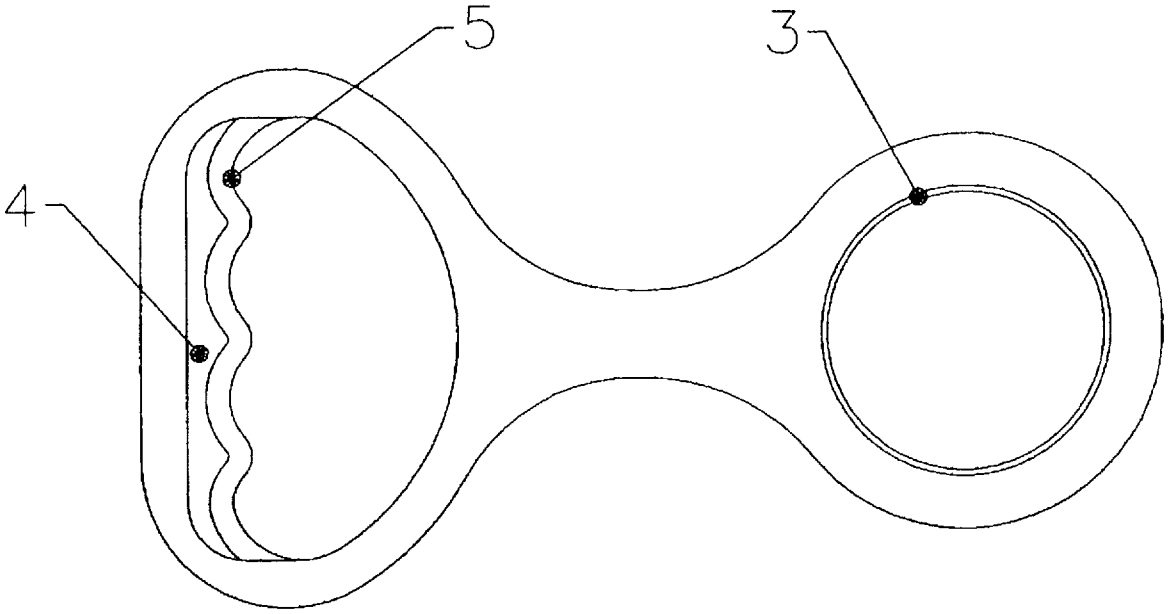
FIG. 3 is a bottom view
Figure 4:
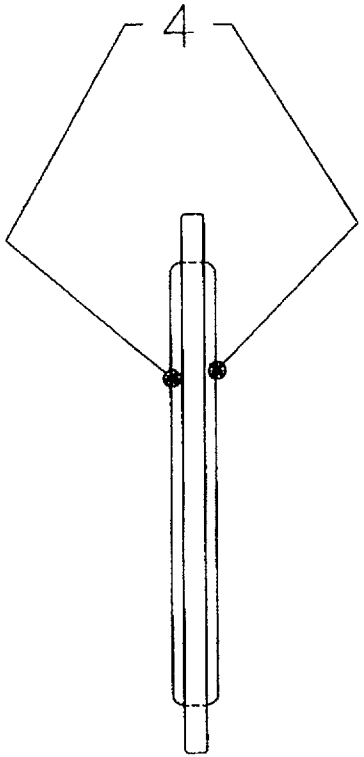
FIG. 4 is an end view
Figure 5:
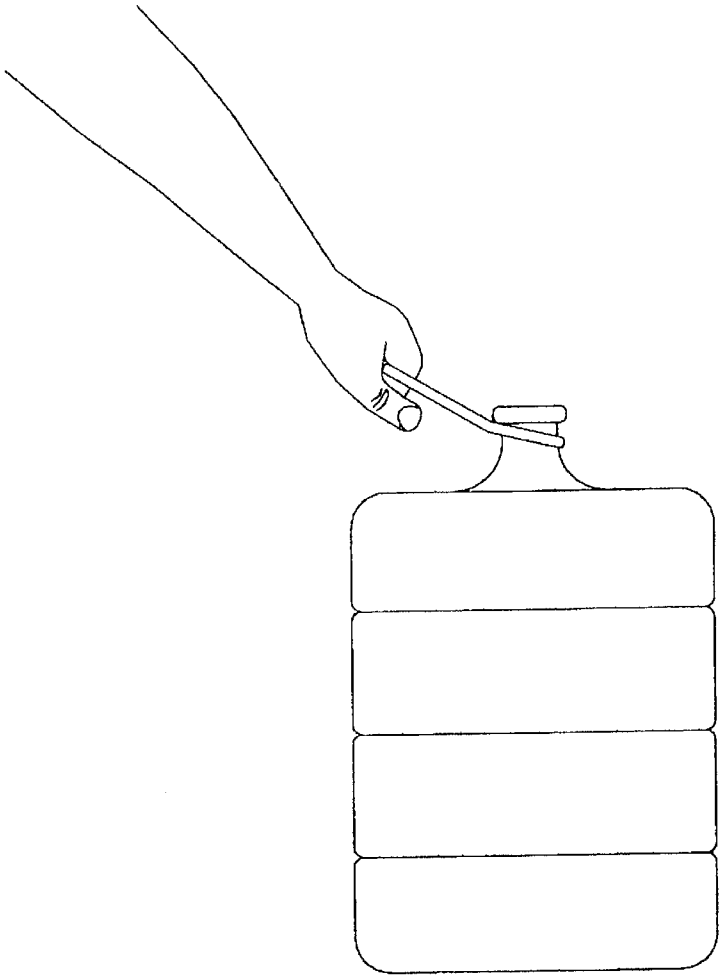
FIG. 5 is a view of a water bottle being carried by the invented lifter.

This bottle lifting and handling device is designed to provide a reusable, inexpensive, safe and easy to use device for lifting bottles in the 5 gallon size. A smaller version of the same invention can be produced for the smaller 2 ½ gallon size version of water bottles.

This invention takes advantage of the fact that the neck of this type of water bottle has a molded ring at the top. This molded ring serves as a locating device when the bottle is placed upside down in the storage and dispensing cabinet. The neck ring is used in this invention, as an area where the clamping forces needed to lift the bottle can be applied.

This invention is constructed of a body 1, approximately 22 cm in length, which is a flat piece of molded plastic material in which two voids are molded. Void 2 approximately 5 cm by 10 cm is constructed so that a human hand will fit comfortably in the void. Comfort is also enhanced by the addition of two molded surfaces 5 that protrude from the body 1 so as to provide additional contact surface to avoid the surface of the body 1 cutting into the hand during lifting and carrying of the bottle. Additionally, finger depressions 6 are molded into the finger gripping area of void 2 . The second void 3 is dimensioned at approximately 6 cm, such that it will easily slip over the molded ring atop the neck of the bottle. This void has a relief angled molded into it so that the diameter of the void 3 increases as it goes from the top to the bottom of the approximately 0.5 cm thick body. The increasing diameter is designed so as to provide gripping of only the top edge of the void 3 when the body 1 is raised into position to lift the bottle. The establishment of neck to body contact surface is in two planes, both of which are on the top edge of the void 3.

Even though the void 3 is large enough to allow easy slipping over the molded ring, in the neck of the bottle and its sealing cap, when the body 1 is lifted by raising the hand, the only surface in contact with the neck of the bottle and the lifter will be on the upper edges of void 3. One surface in the direction of void 2, and the other surface directly opposite the first. This lifting action will pinch the neck of the bottle between the two contact surfaces, and the neck ring will prevent the bottle from slipping from the lifter.

The above described embodiments of this invention are descriptive of: its principal of operation, its advantages over previous designs and its approximate dimensions. These are not to be considered limiting, but instead the scope of this invention shall be determined from the following claims, including their equivalents.

What is claimed is:

1. A reusable bottle handle made from a single piece of relatively flat rigid plastic, where such handle comprises:

a) a hand holding void with finger depression contours to comfortably accommodate a human hand, b) a bottle neck holding void having a tapered hole with substantially smooth sides that permits the handle to be easily engaged with the bottle by slipping the bottle neck holding void over the bottle neck, while at the same time providing for positive engagement of the handle to the bottle neck when upward force is applied to the hand position void.

* * * * *